US005732781A

United States Patent [19]

Chambers

[11] Patent Number: 5,732,781

[45] Date of Patent: Mar. 31, 1998

[54] MECHANISM TO LATERALLY TILT FRONT END LOADER BUCKETS

[76] Inventor: Robert H. Chambers, 675 Selkirk Rd., Sandpoint, Id. 83864

[21] Appl. No.: 689,641

[22] Filed: Aug. 12, 1996

[51] Int. Cl.[6] ..... E02F 3/76

[52] U.S. Cl. ..... 172/825; 172/826; 172/831

[58] Field of Search ..... 172/825, 824, 172/797, 272, 828, 826, 810, 831, 821, 822; 37/468, 408, 442; 414/723, 697, 705

[56] References Cited

U.S. PATENT DOCUMENTS

| | | | |
|---|---|---|---|
| 2,753,638 | 7/1956 | Mork . | |
| 3,083,480 | 4/1963 | Kirchler | 172/825 |
| 3,926,263 | 12/1975 | Frisbee et al. | 172/825 |
| 3,941,262 | 3/1976 | Moser et al. | 37/468 X |
| 4,044,843 | 8/1977 | Holub . | |
| 4,147,218 | 4/1979 | Stedman . | |
| 4,281,721 | 8/1981 | Beales | 172/821 |
| 4,337,837 | 7/1982 | Nissen . | |
| 4,824,319 | 4/1989 | Arnold . | |
| 4,848,010 | 7/1989 | Zimmerman . | |
| 4,966,240 | 10/1990 | Aikawa . | |

FOREIGN PATENT DOCUMENTS

| | | | |
|---|---|---|---|
| 406083 | 7/1966 | Switzerland | 172/807 |
| 656569 | 4/1979 | U.S.S.R. | 172/825 |

*Primary Examiner*—Terry Lee Melius
*Assistant Examiner*—Christopher J. Novosad
*Attorney, Agent, or Firm*—Keith S. Bergman

[57] ABSTRACT

A mechanism to interfit between the bucket of a front end loader and its support and tilting arms allows the bucket be tilted in a laterally extending vertical plane. The mechanism provides a rear plate, having rearwardly extending fastening structure to pivotally interconnect to the support and tilting arms, pivotally carrying a front plate having forwardly extending fastening structure to immovably interconnect the bucket. The pivotal interconnection of the front plate with the rear plate is accomplished by a medial journaling pin, journaling channels at each lateral end of the rear plate that carry the lateral portions of the front plate and a medial nut and bolt combination extending therebetween to allow limited pivotal motion. A first species of mounting mechanism powers the tilting motion of the bucket by an asymmetrically positioned, horizontally extending hydraulic cylinder, and a second species powers the tilting motion by an asymmetrically positioned, vertically extending hydraulic cylinder. The mechanism is usable with front end loaders having either one or two tilting arms.

5 Claims, 5 Drawing Sheets

MECHANISM TO LATERALLY TILT FRONT END LOADER BUCKETS

BACKGROUND OF INVENTION

1. Related Applications

There are no applications related hereto heretofore filed in this or any foreign country.

2. Field of Invention

This invention relates generally to front end loaders, and more particularly to a mounting mechanism interposed between a bucket and its mounting structure to allow pivotal motion of the bucket in a laterally extending vertical plane.

3. Background and Description of Prior Art

The so called front end loader, providing a machine with forwardly extending mounting arms carrying a bucket that is vertically movable and tiltable in a vertical plane extending lengthwise through the machine has become a popular and widely used earth moving machine, especially for lighter earth moving and excavation activities. Such machines sometimes are combined with a rearwardly extending backhoe mechanism to increase their versatility. Though the versatility of front end loaders is substantial, it is not complete. The instant invention seeks to increase this versatility by providing a mounting mechanism interposed between a front end loader bucket and its mounting mechanism that allows tilting of the bucket in a transversely extending vertical plane to increase the utility of such machines, especially for the grading of angulated surfaces such as berms, ditches, embankments and the like.

The front end loaders of modern commerce generally provide two spacedly adjacent lifting arms extending forwardly from the vehicle to vertically move the bucket. One group of such machines provides a single medially positioned tilting arm that tilts the bucket in a vertically extending elongate plane for dumping, while a second group provides two spaced, laterally positioned tilting arms generally associated with the lifting arms to serve this purpose. My lateral tilting mechanism may be used with either group of front end loader tilting mechanisms by use of appropriate mounting means to interconnect with the particular tilting mechanism involved.

Various earth moving equipment has heretofore become known that allows a scraping blade to tilt in a laterally extending vertical plane relative to the machine propelling it, such as in the angled blade bulldozer, road grader or the like. Mechanism allowing such motion has also become known in connection with backhoes, though it has not been widely used in that field, probably because of the complexity and inconvenience of the mechanical linkages involved that allow such motion. The instant invention, however, allows such motion for buckets of front end loaders by a mechanism which is merely an attachment that may be releasably added to existing front end loaders between the bucket and its support mechanism to provide its functioning without modification of the original front end loader components.

Since front end loaders commonly operate under maximal stress conditions, it is necessary that my mounting structure, to be economically viable, must operate under similar conditions and must not weaken the ordinary maximum operating parameters of the original front end loader in which it is embodied. To accomplish this end, my tilting mechanism in essence provides two pivotally related, laterally extending plates of substantial areal extent that mount the front end loader bucket on the front plate and the support structure on the rear plate, both of which are pivotally interconnected by a medial pivot pin, lateral pivot channels and at least one nut-bolt combination. This construction provides a structure that is as strong as the original front end loader components on either side thereof and provides interconnections that are at least as strong as those existent when the bucket is interconnected directly on the support structure of the front end loader.

My invention resides not in any one of these features individually, but rather in the synergistic combination of all of its structures that necessarily give rise to the functions flowing therefrom as specified and claimed.

SUMMARY OF INVENTION

My invention generally provides a mounting mechanism interposed between the bucket of a front end loader and the bucket mounting and tilting structure. The mounting mechanism provides a laterally elongate, flat rear plate having areal extent substantially as great as the maximum cross-sectional area of a bucket to be serviced. The rearward surface of the rear plate defines connecting structure to pivotally interconnect with the lifting and tilting arms of the front end loader. A front plate is pivotally mounted on the rear plate and defines on its forward surface mounting structure to interconnect with the mounting structure carried on the rearward surface of the bucket. In a first species, the forward plate is powered for pivotal motion by a horizontally oriented, double acting hydraulic cylinder asymmetrically carried on one lateral side of the rearward plate to extend across the middle of the plates and interconnect with a bracket carried by the forward plate on the other lateral side. In a second species, the forward plate is powered for pivotal motion by a vertically oriented double acting hydraulic cylinder carried in an asymmetrical position on the rearward plate and pivotally interconnected with a bracket carried by the forward plate forwardly of the hydraulic cylinder. Hydraulic power for either species of hydraulic powering cylinders is provided by the existing hydraulic system of a front end loader to be serviced.

In providing such a device, it is:

A principal object to provide a mounting mechanism interposed between the bucket and bucket mounting structure of a front end loader to allow the bucket to be pivoted in a laterally extending, vertically oriented plane.

A further object is to provide such a mechanism that may be used in an existing front end loader without modification of the front end loader or its bucket.

A further object is to provide such a mechanism that is as strong as the original front end loader structure and provides interconnecting structures that are as strong as if the bucket and front end loader were interconnected to each other without my mechanism.

A further object is to provide such a structure with protected pivotal surfaces to provide long maintenance free life in the mechanically adverse environs in which front end loaders are used.

A still further object is to provide such a mechanism that is powered for pivotal motion by either a vertically or a horizontally oriented hydraulic cylinder interconnected between the forward and rearward mounting plates of my mechanism and operated by the existing hydraulic powering system of the front end loader being serviced.

A still further object is to provide such a mechanism that is of new and novel design, of rugged and durable nature, of simple and economic manufacture and otherwise well adapted to the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement with only one preferred and practical embodiment of the best known mode being illustrated in the accompanying drawings and specified as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

My invention generally provides mounting mechanism 12 interconnected between front end loader 10 and its bucket 11 to allow powered tilting motion of the bucket in a laterally extending, vertically oriented plane.

Figure 1:
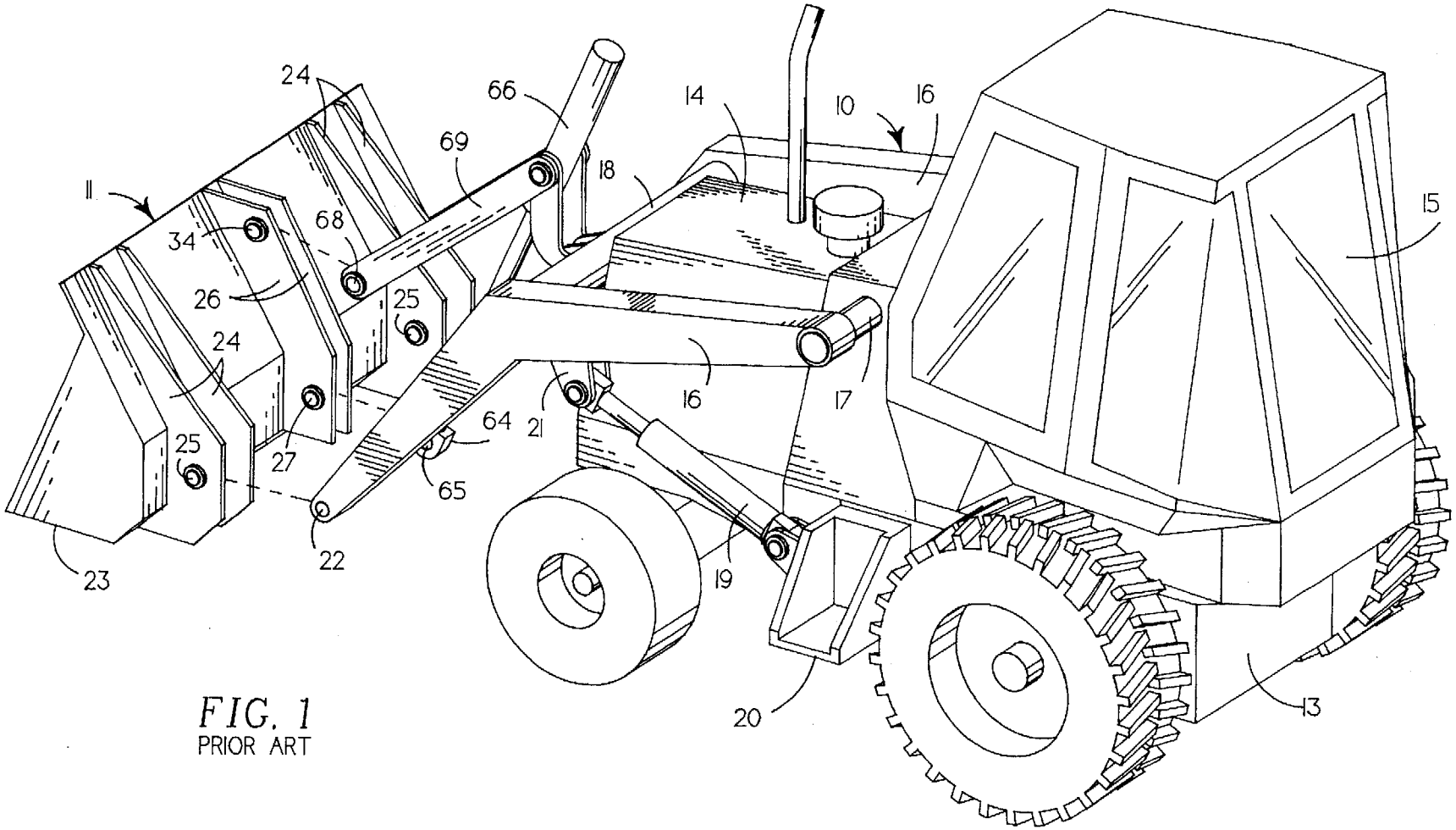
FIG. 1 PRIOR ART
FIG. 1 is an isometric view of a typical front end loader of modern commerce having a single medial tilting arm, with the bucket removed for illustrational clarity.

As seen in FIG. 1, front end loader 10 provides wheeled vehicle 13 having forward engine casement 14 and rearward operator cab 15. Similar paired opposed lift arms 16 of angulated configuration are pivotally mounted in the upper rearward portion of engine casement 14 by laterally extending, axially coincident journals 17 supported by vehicle frame elements. The two lift arms 16 are interconnected by cross support 18 forwardly of engine casement 14 and the forward portions of the lift arms extend forwardly and downwardly from that cross support 18. Similar paired opposed hydraulic lifting cylinders 19 extend on each side of the vehicle 13 from rearward lift arm cylinder brackets 20, positioned on the lower portion of the vehicle frame at the rearward extension of the engine casement, forwardly and upwardly to pivotally interconnect with forward lift arm cylinder brackets 21 depending from each lift arm spacedly rearwardly of cross support 18. The forwardmost portion of each lift arm 16 defines journal 22 to pivotally mount on a connecting pin carried by the rearward portion of the loader bucket 11.

Bucket 11 provides laterally elongate, scoop-shaped body 23 defining spaced paired lift arm brackets 24 in each lateral end portion. Each pair of lift brackets 24 carry lift arm pins 25 extending therebetween in their lower rearward portions to extend through journals 22 of associated lift arms 16 to pivotally mount the bucket on the lift arm.

Figure 3:
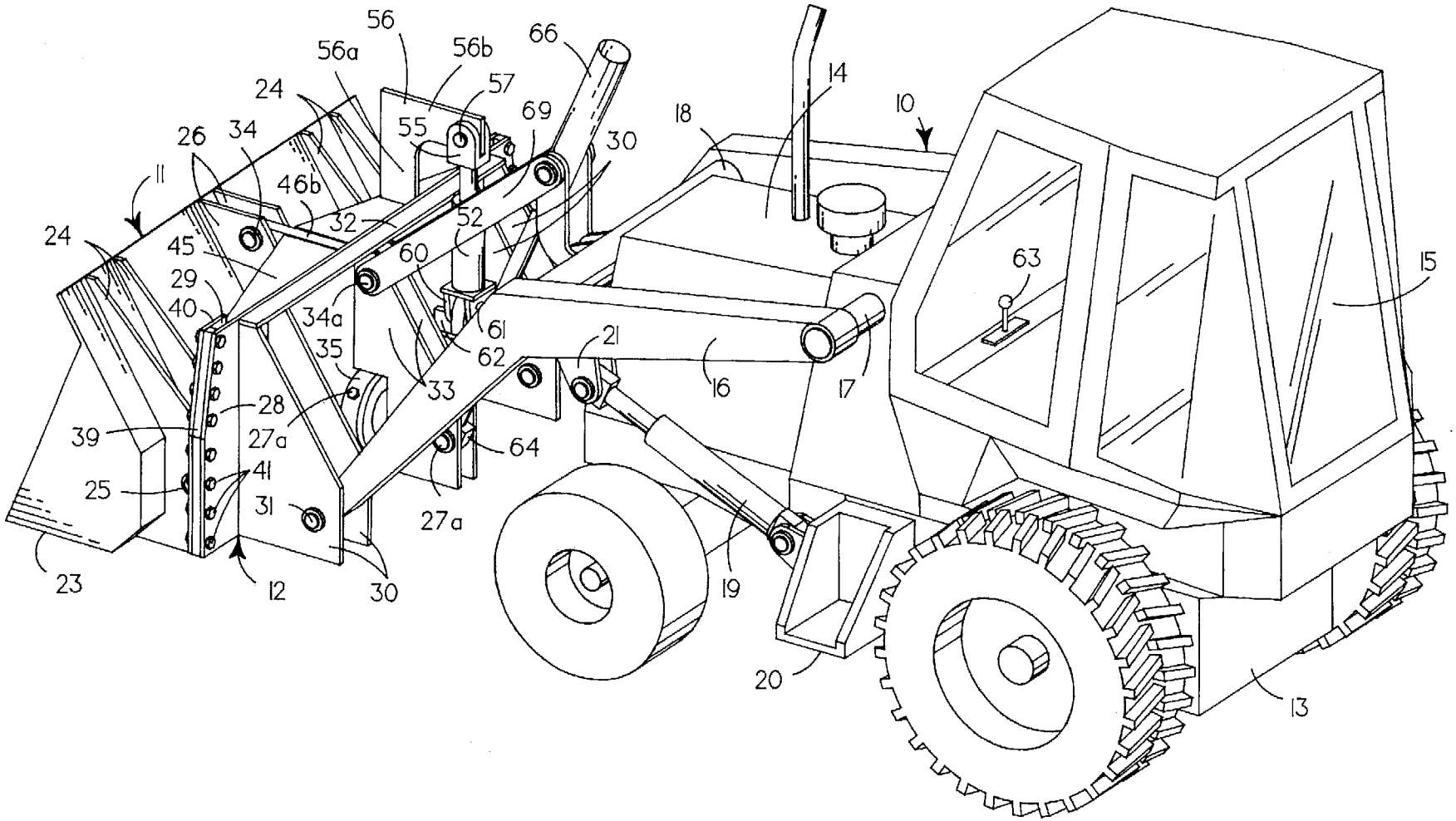
FIG. 3 is an isometric surface view of the front end loader of FIG. 1 assembled with my mounting mechanism of the second species, powered by an asymmetrical positioned, vertically oriented hydraulic cylinder extending between front and rear plates.

In the single tilt arm end loader of FIGS. 1 and 3, the scoop body 23 defines a pair of similar medially positioned, rearwardly extending lift arm brackets 26 carrying tilt arm pin 27 extending therebetween in their lower portions and a tilt support arm pin 34 extending therebetween in their upper portions. The tilt arm pin 27 extends through journal 65 defined in tilt arm bracket 64 carried by the piston rod of tilting cylinder 66 to pivotally interconnect the cylinder with the bucket. One tilt support arm pin 34 extends through journals 68 defined in the forward end portions of similar opposed tilt support arms 69 that extend from pivotal mounting on the lower portion of tilting cylinder 66 to provide additional strength and support for the mounting structure.

Figure 2:
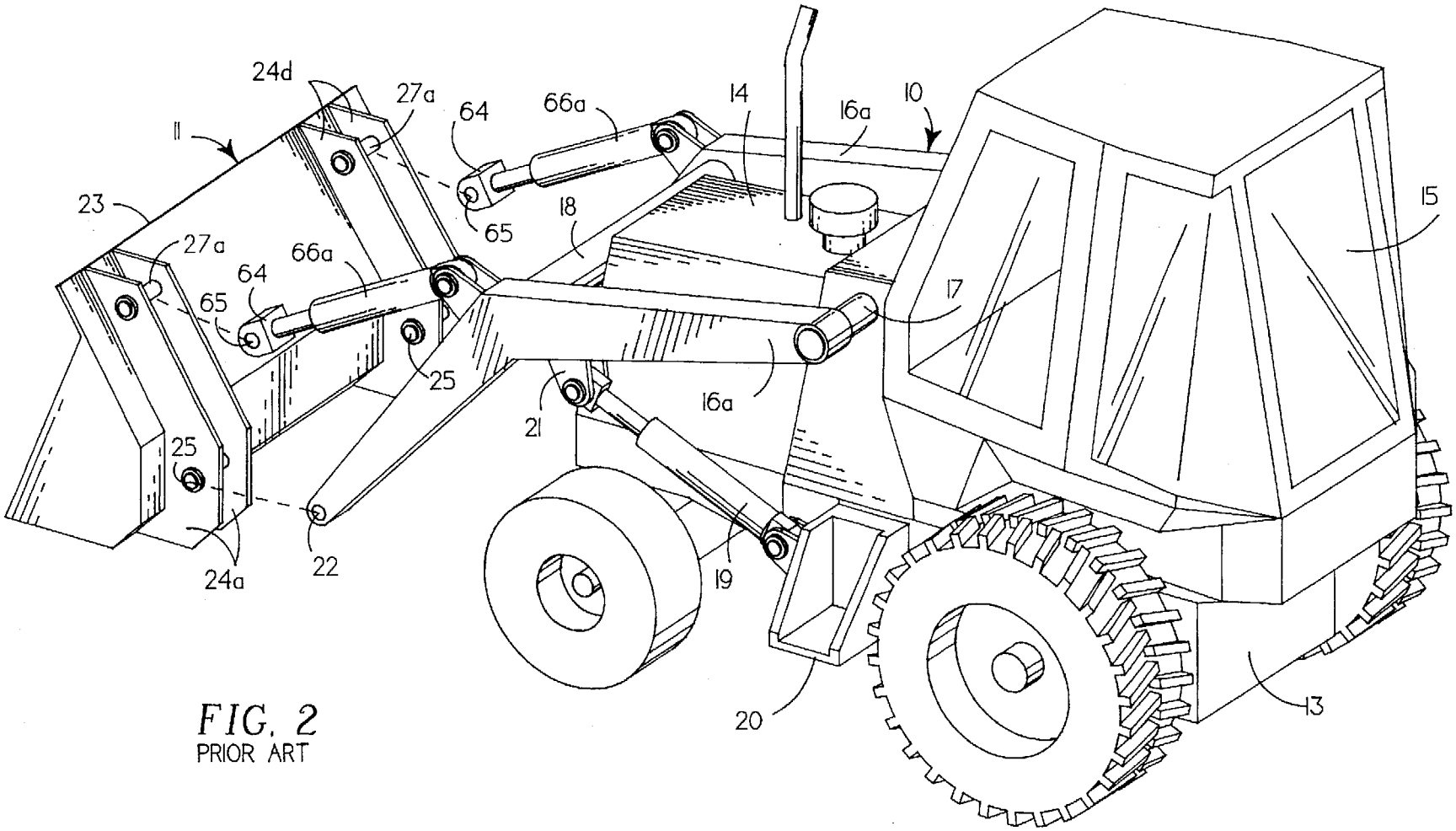
FIG. 2 PRIOR ART
FIG. 2 is an isometric view of a typical front end loader of modern commerce having paired opposed tilting arms, with the bucket removed from interconnection therewith for illustrational clarity.
Figure 4:
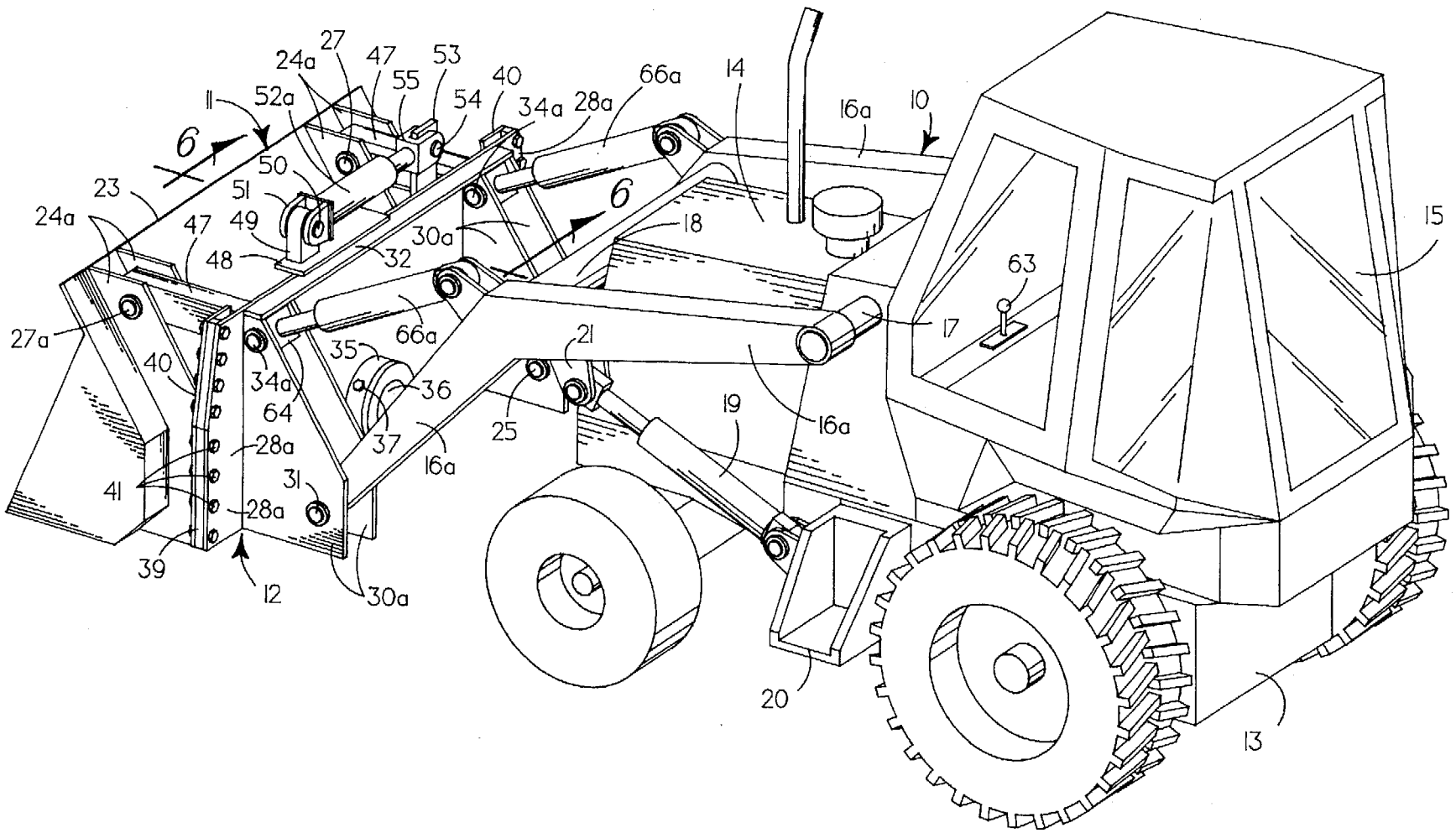
FIG. 4 is an isometric surface view of the front end loader of FIG. 2, with my mounting mechanism of the first species, powered by horizontally oriented hydraulic cylinder extending between laterally opposed connection points on the front and rear plates.

In the species of front end loader shown in FIGS. 2 and 4 which provides paired opposed tilt arms, there is no medial tilt arm bracket, but rather tilting cylinder pins **27*a* are carried in the upper rearward portion of lift brackets 24*a* as illustrated. In this type of front end loader, the tilting cylinders 66*a* are pivotally mounted vertically above lift arms 16*a* to allow the lift arm brackets 24*a* to carry both the tilting cylinder pins 27*a* and lift arm pins 25**.

One or the other of the front end loader structures described are those prevalent in modern day commerce and both have become somewhat standardized in configuration amongst manufacturers in the industry. It is with both such front end loaders that my invention is operative.

My mounting mechanism 12 provides flat elongate rear plate 28 pivotally carrying flat front plate 29 of somewhat similar peripheral configuration. The rear plate 28 has peripheral configuration similar to the traverse cross-section of maximum area through bucket 11 to provide appropriate interconnection of the device with a front end loader and necessary strength and rigidity for my mechanism. The lateral dimension of the forward plate is less than that of the rear plate and the laterally vertical edges of the front plate are of circularly arcuate configuration to allow pivotal mounting of the front plate on the rear plate as hereinafter specified.

The rearwardly facing surface of rear plate 28 defines similar spaced pairs of spacedly related lift arm brackets 30 extending rearwardly from each of its lateral portions. Each lift arm bracket 30 in its lower rear portion defines holes to releasably carry lift arm pins 31 therebetween to pivotally journal lift arm 16 of an associated front end loader. In the structure illustrated, rearwardly extending top plate 32 communicates between the upper portions of the lift arm brackets 30 to provide additional strength and rigidity for the rear plate in this area. The lift arm brackets 30 and pins 31 are dimensioned, configured and arrayed substantially similarly to the lift arm brackets 24 and pins 25 provided by the bucket 23 of the associated front end loader so that my mounting mechanism may interfit with a front end loader in the same fashion as its original bucket and may be similarly operated.

For use with the single tilt arm type front end loader of FIGS. 1 and 3, the rear plate 28 structurally carries similar spaced, vertically extending tilt arm brackets 33, carrying a tilt arm pin **27*a* extending therebetween in their lower portions to pivotally interconnect the journal 65 defined in bracket 64 carried by the piston rod of tilting cylinder 66. A tilt support arm pin 34*a* is carried between the tilt arm brackets 33 in their upper portions to extend through journals 68 defined in the forward end portions of tilt support arms 69 to pivotally mount those arms. The tilt arm brackets and pins are similarly sized, configured and arrayed as those corresponding elements defined on the rearward surface of the bucket 11 so as to interconnect with the structure of the front end loader in the same operative fashion as did the bucket 23**.

Figure 6:
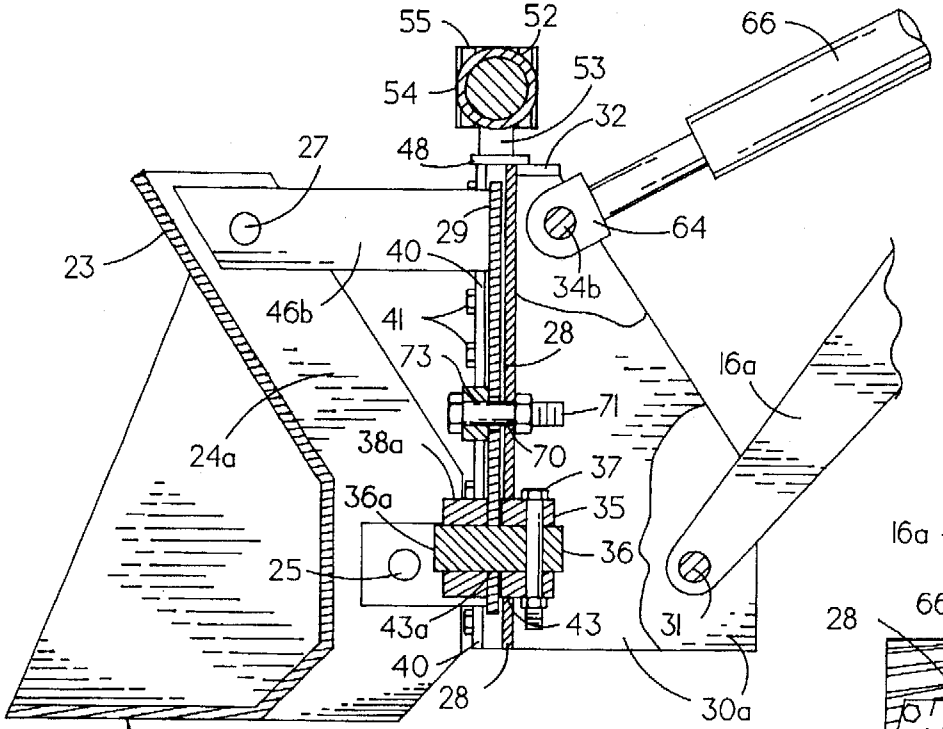
FIG. 6 is a partial vertical cross-sectional view through the bucket and forward mounting structure of the front end loader of FIG. 4, taken on the line 6—6 thereon in the direction indicated by the arrows.

As seen in FIG. 6, the lower medial portion of rear plate 28 defines hole 43 carrying pivot pin collar 35 carrying forwardly extending pivot pin 36 which is releasably and irrotatably maintained in the pivot pin collar by fastening nut-bolt combination 37 extending therebetween. The front plate 29 carries pivot pin collar 38*a* in axial alignment with the fastening pin to receive and journal the forward portion of the pivot pin. The rear plate 28, spacedly above the pivot pin 36 in a vertically medially position, defines fastening bolt hole 70 carrying nut-bolt combination 71 to fasten the front and rear plates together.

The lateral vertical edge portions of rear plate 28 on their forward surfaces each carry elongate, inwardly extending bearing plates 39 each having a circularly arcuate inward facing surface with a radius equal to the distance of the surface from the axis of pivot pin 36 so that the lateral edges of front plate 29 may pivot therebetween. The lateral bearing plates 39 are fastened for positional maintenance on rear plate 28 by similar edge plates 40, extending inwardly toward each other a spaced distance greater than the inward extension of the bearing plates, so as to create a channel between each lateral edge plate and the rear plate in which a lateral end portion of the front plate is positionally maintained. The edge plates 40 are releasably interconnected to the associated bearing plate and the rear plate by plural spaced nut-bolt combinations 41 releasably extending therebetween.

The rear plate 28*a* for use with the species of front end loader illustrated in FIGS. 2 and 4 having two paired opposed tilting arms, does not require medial tilt arm brackets. The lift arm brackets 30*a* define tilt arm pin holes in their upper portions that carry tilt arm pins 34*b* therebetween to pivotally interconnect a tilt arm 66*a* of a front end loader with the rear plate 28*a* of my mounting structure in a fashion similar to that in which the bucket 23 of this type of loader is attached to the tilt arms 16*a*. The other elements of this rear plate 28*a* are the same as in the rear plate 28 specified for use with a front end loader having a single tilt arm.

Figure 5:
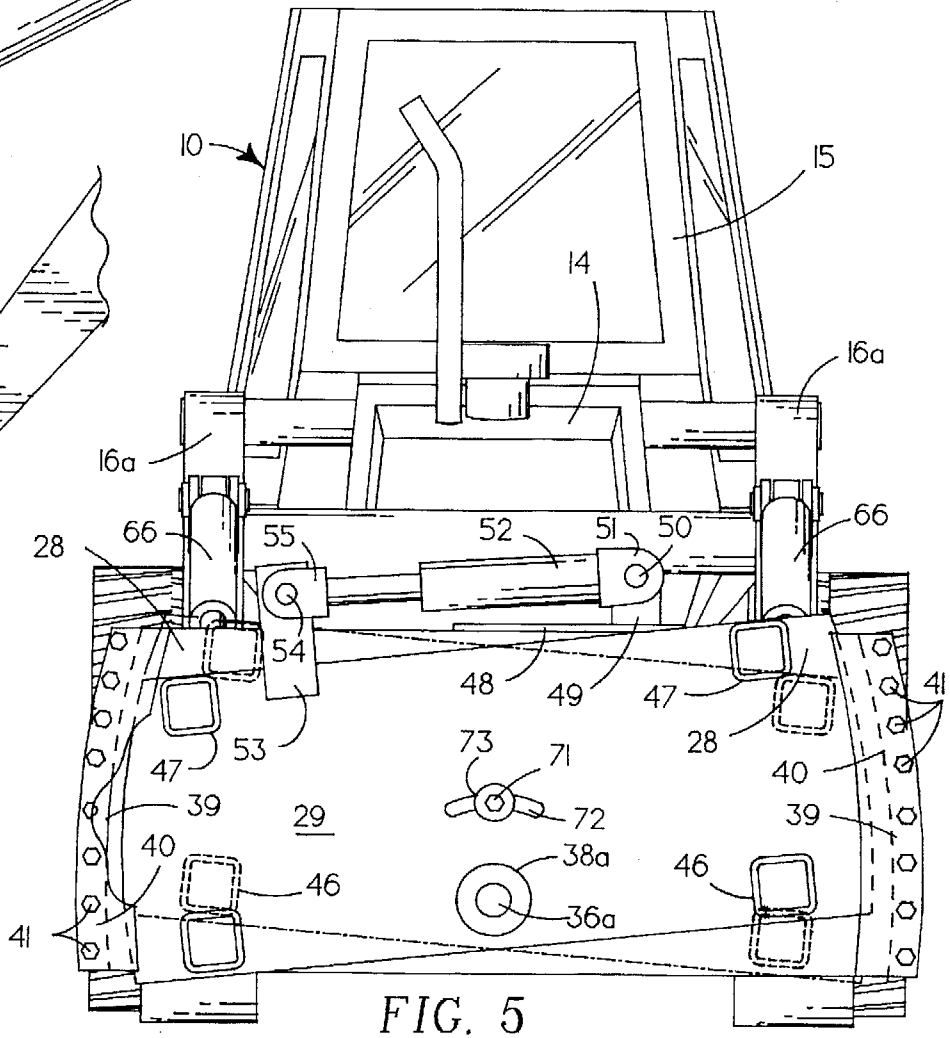
FIG. 5 is an orthographic front view of the front end loader of FIG. 4 with the bucket removed to show an alternate angled position of the front plate in dashed outline.

Front plate 29 as seen in FIGS. 5 and 6 is a planar element of peripheral shape similar to but incrementally smaller than the peripheral shape of rear plate 28. The front plate defines in its lower medial portion pivot pin hole 43*a* carrying journal 38*a* to allow passage of the forward portion of pivot pin 36 therethrough and journal that pin. The front plate is maintained forwardly adjacent the rear plate by bolt-nut combination 71 extending through hole 70 defined in the rear plate and arcuate slot 72 defined in the forward plate. The slot 72 has a width incrementally larger than the bolt of combination 71 to allow sliding motion of the bolt in the slot and has an arcuate configuration concentric with pivot pin 36 to allow the front plate to pivot relative to the rear plate. Preferably the bolt carries washer 73 extending thereabout forwardly of the front plate to aid its fastening function.

The lateral side edges of the front plate define circular arcs, with a radius incrementally less than the distance from the axis of pivot pin 36 to the adjacent surface of lateral bearing plates 39 and concentric about the pivot pin axis, such that the lateral end portions of the front plate 29 will extend within the channels defined between the rear plate and forward edge plates 40 and the forward plate will pivot between the lateral bearing plates. The upper edge of front plate 29 in the species of FIG. 3 carries forwardly extending forward top plate 45 to provide additional strength and allow mounting of pivoting mechanism thereon.

The forwardly facing surface of front plate 29 structurally carries forwardly extending bucket fastening arms 46, 47 in the instance illustrated comprising box beams. The lower fastening arms 46 are sized and configured to interfit between paired spaced lift brackets 24 and are fastenably positioned therebetween by lift arm pins 25 extending through pin holes defined in the forward end portions of the lower fastening arms 46. Two similar forwardly extending upper fastening arms 47 are carried on the front plate 29 to extend forwardly to provide at least a three point connection of the bucket 23 with the front plate. In the one tilt arm species of FIG. 1, upper fastening arm 47 is arrayed and configured to extend between lift arm brackets 26 and be their releasably fastened by tilt arm pin 34. In the two tilt arm species illustrated in FIG. 4, two laterally positioned upper fastening arms 47 are provided in spaced lateral positions to extend forwardly between lift brackets 24*a* and be there releasably fastened by tilt arm pins 27*a* passing through holes defined in the forward end portions of the fastening arms 47. This interconnection of the bucket 11 to the front plate 29 at at least three points will immovably mount the bucket to the front plate so that neither will move relative to the other responsive to motion of the front plate relative to the vehicle 10.

To accomplish tilting motion of bucket 11 in a transversely extending vertical plane at the interface of rear plate 28 and front plate 29, I provide powering mechanism comprising a double acting hydraulic cylinder 52 extending asymmetrically between the front and rear plates. This hydraulic cylinder may be oriented in the substantially horizontal fashion illustrated in the first species of FIGS. 1 and 3, in a substantially vertical fashion illustrated in the second species of FIGS. 2 and 4, or in an angulated fashion between the horizontal and the vertical (not illustrated).

In the first species of powering mechanism seen in FIGS. 4 and 5, I provide horizontal cylinder mounting plate 48 structurally carried in a lateral position on the top of top plate 32 on one lateral side of pivot pin 36. Mounting plate 48 carries upstanding mounting post 49 which carries fastening pin 50 to pivotally interconnect the fastening ears 51 carried by double acting hydraulic cylinder 52. The front plate 29 carries vertically upstanding cylinder fastening plate 53 on the lateral side of pivot pin 36 opposite that on which the cylinder mounting post 49 is carried. The fastening plate 53 extends spacedly upwardly above the upper edge of front plate 29 to carry fastening pin 54 which pivotally interconnects fastening ears 55 carried by the piston rod of hydraulic cylinder 52. The hydraulic cylinder 52 is powered by the existing hydraulic system of front end loader 10 and adjustably regulated for extensive position by hydraulic control 63 carried in the cab 15 of loader 10. With this mechanism then as the cylinder 52 changes length between its fastening pins 50 and 54, the front plate 29 will be pivotally moved relative to the rear plate 28. This pivotal motion can practically range about fifteen to twenty degrees from the horizontal which allows any practical grading angles required for the bucket.

In the second species of vertically oriented hydraulic cylinder illustrated in FIG. 3, L-shaped cylinder mounting arm 56, having vertical leg 56*a* and rearwardly extending horizontal leg 56*b*, is carried in a lateral position relative to pivot pin 36 by top plate 45 to extend upwardly therefrom. The rearward end portion of horizontal leg 56*b* carries cylinder mounting pin 57 that pivotally mounts connecting ears 55 of the piston rod of hydraulic cylinder 52*a*. The hydraulic cylinder 52*a* depends from this pivotal interconnection to be fastened by cylinder mounting ears 60 by a fastening pin 61 carried in bracket 62 which is structurally carried by the rearward surface of rear plate 28. Hydraulic cylinder 52*a* is powered by the existing hydraulic system of front end loader 10 and regulated for extensive length by hydraulic control 63 located in the vehicle cab 15. As the cylinder 52 moves to change length between fastening pins 57 and 61, the front plate 29 will be responsively pivoted parallel to the rear plate 28.

Having thusly described my invention, its operation may be understood.

Mounting mechanism 12 constructed according to the foregoing specification is chosen for the particular type of front end loader with which it is to be used, having either one tilt arm or two paired opposed tilt arms. The front end loaders of present day commerce are somewhat dimensionally and configurationally standardized within one category or the other and one particular configuration of mounting mechanism therefore will fit upon front end loaders of a particular type from various manufacturers. Either species of mounting mechanism may have either a horizontally or vertically oriented powering cylinder and is used in substantially the same fashion as the other.

For use, the bucket 11 of the front end loader 10 is removed from its interconnection with lift arms 16 and tilt arm or arms 66. My mounting mechanism 12 is then attached to the front end loader with lift arms 16 carried between lift arm brackets 30 and there positionally maintained for pivotal motion in a vertically extending elongate plane by lift arm pins 31. In the loader of FIG. 3 tilt arm 66 is carried between tilt arm brackets 33 and there positionally maintained by tilt arm pin 27*a* or in the loader of FIG. 4 the tilt arms 66 are carried between the upper portions of the lift arm brackets 30*a* and there maintained by tilt arm pins 34*b*. The bucket 11 then is interconnected to the lower fastening arms 46 and upper fastening arm or arms 47 carried by the front plate 29 to rigidly interconnect the bucket and front plate. The hydraulic cylinder 52 and its control mechanism then are interconnected in the existing hydraulic system of the front end loader 10 and the mounting mechanism is ready for operation responsive to motion of hydraulic control 63.

With my mounting mechanism 12 attached between the front end loader 10 and bucket 11, the normal lifting and tilting operations of the bucket may be carried out in the same fashion as with the front end loader when the bucket was directly interconnected thereto without my invention. To use my mechanism to tilt the bucket, the powering cylinder 52 is actuated by control 63 to either extend or contract the cylinder length between its connecting pins and as this is accomplished, the front plate 29 on which the bucket is carried will be pivoted responsively in a vertical plane extending between the plates and perpendicular to the horizontal axis of pivot pin 36. The direction of the pivotal motion will vary by obvious mechanical principles depending on the positioning and orientation of the powering cylinders relative to the front and rear plates. Pivotal motion of the bucket may readily be accomplished through angles of fifteen to twenty degrees from the horizontal and in fact theoretically through greater angles.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A mounting mechanism for interconnection between a front end loader, having two laterally positioned forwardly extending lift arms and at least one forwardly extending tilt arm, and a bucket, to allow motion of the bucket in a vertical laterally extending plane, comprising in combination:

a rear plate carried by the front end loader, said rear plate having rearwardly extending means for pivotally interconnecting with the lift arms and at least one tilt arm of the front end loader for pivotal motion in a vertically extending elongate plane, a pivot pin carried by the rear plate in a medial position to extend forwardly thereof to pivotally interconnect a front plate, bearing plates having a forward surface carried on the forward surface of each lateral edge portion of the rear plate and having inwardly facing edges configured to allow pivotal motion of the front plate therebetween, lateral edge plates carried on the forward surface of each bearing plate to extend over each bearing plate and inwardly toward each other spacedly beyond the inward extension of the bearing plates, said edge plates releasably fastened to the bearing plates and the rear plate by plural spaced nuts and cooperating bolts extending therebetween;

the front plate carried immediately forwardly of the rear plate, said front plate having a pivot pin journal to receive the forwardly extending pivot pin carried by the rear plate, lateral side edges extending outwardly spacedly adjacent the lateral bearing plates to allow pivotal motion of the front plate between the bearing plates and between the rear plate and edge plates;

forwardly extending means for immovably interconnecting the bucket of the front end loader to the front plate; and means for adjustably pivotally moving the front plate relative to the rear plate, including an hydraulic cylinder communicating between the front plate and rear plate.

2. A mounting mechanism for interconnection between a front end loader, having two laterally positioned forwardly extending lift arms and at least one forwardly extending tilt arm, and a bucket, to allow motion of the bucket in a vertical laterally extending plane, comprising in combination:

a rear plate with forward and rearward surfaces carried by the front end loader, said rear plate having opposed pairs of rearwardly extending lift arm brackets carrying fastening pins to pivotally interconnect the lift arms of the front end loader for vertical pivotal motion, rearwardly extending tilt arm fastening bracket means to pivotally interconnect the at least one tilt arm of the front end loader, a pivot pin carried by the rear plate in a medial position to extend forwardly thereof to pivotally interconnect a front plate, and bearing plates, each having inwardly facing edges, carried on the forward surface of each lateral edge portion of the rear plate, lateral edge plates carried on the forward surface of each bearing plate to extend over the bearing plate and inwardly toward each other spacedly beyond the inward extension of the bearing plates, said edge plates releasably fastened to the bearing plates and the rear plate by plural spaced nuts and cooperating bolts extending therebetween;

the front plate carried forwardly adjacent the rear plate, said front plate having a pivot pin journal to receive the forwardly extending pivot pin carried by the rear plate, lateral side edges extending outwardly spacedly adjacent the lateral bearing plates to allow pivotal motion of the front plate between the bearing plates and between the rear plate and edge plates;

two forwardly extending lower fastening arms each pivotally interconnected by fastening pins to a lift arm bracket of the bucket, and at least one forwardly extending tilt fastening arm interconnected to at least one tilt arm fastening bracket means; and means for adjustably pivotally moving the front plate relative to the rear plate, including an hydraulic cylinder communicating between the front plate and rear plate.

3. The mechanism of claim 2 further comprising the hydraulic cylinder extending substantially horizontally between a first laterally positioned bracket carried by the front plate to extend upwardly thereabove on a first lateral side of the pivot pin and a second bracket carried by the upper portion of the rearward plate to extend upwardly thereabove on a second lateral side of the pivot pin; and control means to adjustably regulate the length of the hydraulic cylinder between the first and second brackets.

4. The mechanism of claim 2 wherein the means for pivotally moving the front plate relative to the rear plate comprise:

the hydraulic cylinder having a first end portion carried by a first L-shaped bracket extending upwardly from the upper portion of the front plate and rearwardly thereof and a second end portion carried by a second bracket carried on the rearward surface of the rear plate spacedly below the first L-shaped bracket; and control means to adjustably regulate the length of the hydraulic cylinder between the first and second brackets.

5. The mechanism of claim 2 wherein:

the inwardly facing edges of the bearing plates are configured as circular arcs concentric with the pivot pin; and the lateral side edges of the front plate are configured as circular arcs concentric with the pivot pin and of incrementally less radius than the adjacent edges of the bearing plates.

* * * * *